US008469411B2

(12) United States Patent
Costigan

(10) Patent No.: US 8,469,411 B2
(45) Date of Patent: Jun. 25, 2013

(54) DOOR HANDLE AND LATCH ASSEMBLY

(75) Inventor: Terrence P. Costigan, Fenton, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 771 days.

(21) Appl. No.: 12/236,569

(22) Filed: Sep. 24, 2008

(65) Prior Publication Data

US 2010/0071165 A1 Mar. 25, 2010

(51) Int. Cl.
*E05B 3/00* (2006.01)

(52) U.S. Cl.
USPC ..... 292/336.3; 292/DIG. 22; 292/DIG. 65

(58) Field of Classification Search
USPC ..... 292/336.3, 92, 93, DIG. 22, DIG. 65
See application file for complete search history.

(56) References Cited

U.S. PATENT DOCUMENTS

| | | | | |
|---|---|---|---|---|
| 5,887,918 | A * | 3/1999 | Okada et al. | 292/336.3 |
| 6,447,030 | B1 * | 9/2002 | Meinke | 292/347 |
| 6,464,270 | B1 * | 10/2002 | Sloan et al. | 292/336.3 |
| 6,612,630 | B1 * | 9/2003 | Meinke | 292/348 |
| 6,719,336 | B2 * | 4/2004 | Sato | 292/336.3 |
| 6,942,260 | B2 * | 9/2005 | Bucker et al. | 292/336.3 |
| 7,011,349 | B2 * | 3/2006 | Nomura et al. | 292/347 |
| 7,070,216 | B2 * | 7/2006 | von zur Muehlen | 292/336.3 |
| 7,232,164 | B2 * | 6/2007 | Lee | 292/336.3 |
| 7,303,217 | B2 * | 12/2007 | Savant | 292/336.3 |
| 7,481,468 | B2 * | 1/2009 | Merideth et al. | 292/137 |
| 7,556,296 | B2 * | 7/2009 | Kondo et al. | 292/336.3 |
| 7,568,744 | B2 * | 8/2009 | Tenorio et al. | 292/336.3 |
| 7,597,368 | B2 * | 10/2009 | Savant et al. | 292/336.3 |
| 2004/0075284 | A1 | 4/2004 | Hillgaertner | |

FOREIGN PATENT DOCUMENTS

| | | | |
|---|---|---|---|
| EP | 1473423 | A2 | 11/2004 |
| WO | W02005042883 | A1 | 12/2005 |

* cited by examiner

*Primary Examiner* — Carlos Lugo
*Assistant Examiner* — Alyson M Merlino

(57) ABSTRACT

An apparatus for operating an automotive vehicle door includes a pivoting door handle, a stop located exterior to the door and engageable by the handle to limit pivoting of the handle, a moveable door latch having an open state and a closed state, and a cable secured to the handle for transmitting movement of the handle to the latch.

11 Claims, 6 Drawing Sheets

DOOR HANDLE AND LATCH ASSEMBLY

BACKGROUND OF INVENTION

This invention relates generally to a door handle for an automotive vehicle, and more particularly to a mechanism for transmitting the handle's pivoting motion to a door latch.

Generally the outside door handle of a motor vehicle includes a handle lever stop, which limits the range through which the door handle pivots. The handle lever stop is conventionally located inboard, i.e., on the interior surface of the door. This feature causes the distance from the window glass to the outer surface of the door panel to be about 55 mm. It is desirable to reduce the depth of the outside door handle sufficiently to enable the glass to outer panel dimension to be reduced to about 35 mm.

Relocating the handle lever stop outboard to the cap reduces handle depth, but requires another method of transferring the opening energy from the handle to the door latch. Installing the handle assembly to the vehicle with a loose cable hanging from it is unacceptable.

A need exists in the industry for an outside door handle that allows the outer door panel to be packaged closer to the window glass in order to enhance styling of the vehicle's body side.

SUMMARY OF INVENTION

An apparatus for operating an automotive vehicle door includes a pivoting door handle, a stop engageable by the handle to limit pivoting of the handle, a moveable door latch having an open state and a closed state, and a cable secured to the handle for transmitting movement of the handle to the latch.

By moving a handle lever stop from a conventional position on the handle chassis to the handle cap, the stop can be moved outboard, thereby considerably reducing the depth of the handle packaging envelope. The reduced depth outside door handle allows the outside door handle to be packaged close to the side glass on the door, enabling a larger exterior styling envelope and leading to more dramatic body side styling.

The scope of applicability of the preferred embodiment will become apparent from the following detailed description, claims and drawings. It should be understood, that the description and specific examples, although indicating preferred embodiments of the invention, are given by way of illustration only. Various changes and modifications to the described embodiments and examples will become apparent to those skilled in the art.

DETAILED DESCRIPTION

Figure 1:
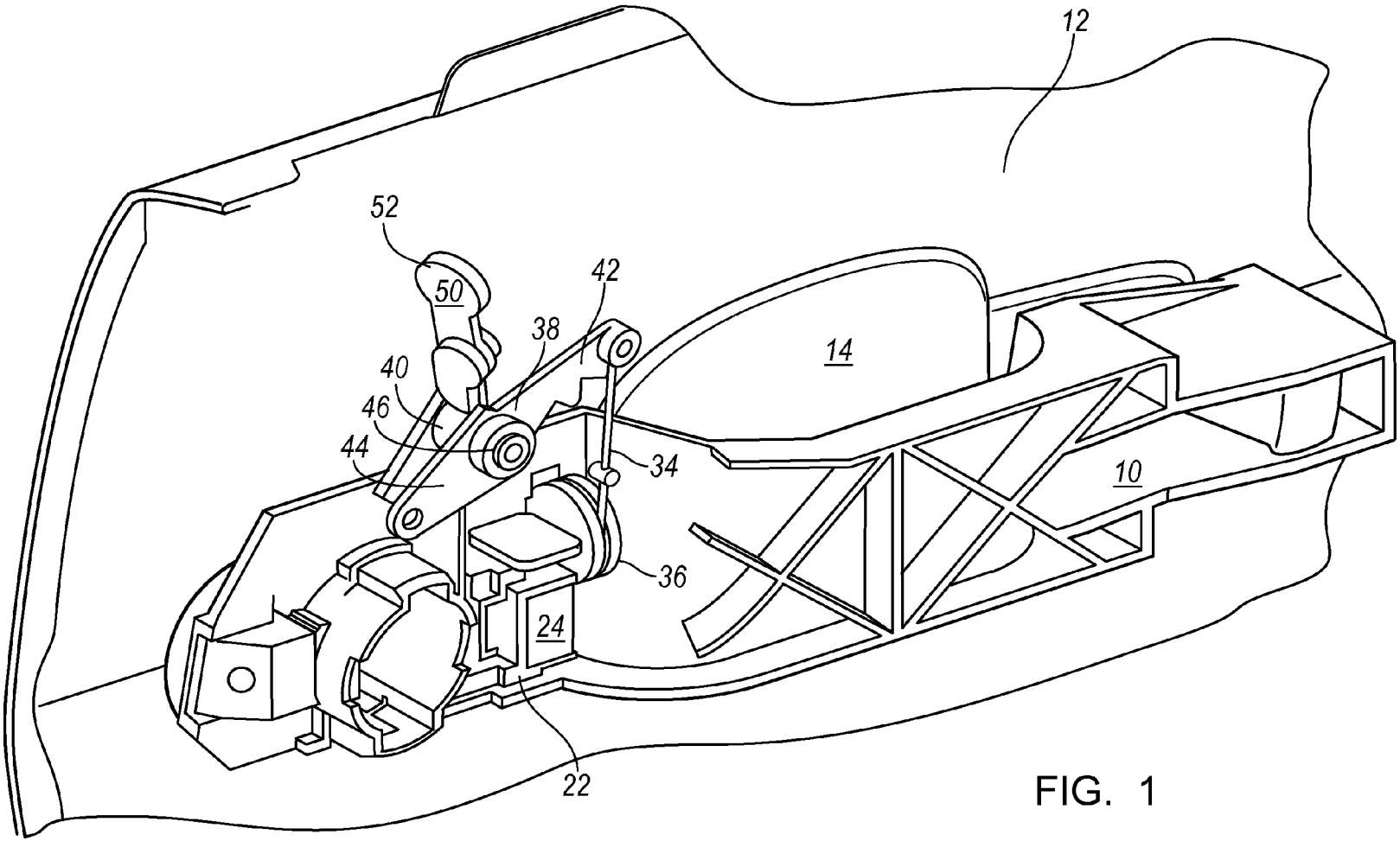
FIG. 1 is a perspective view showing a door handle chassis secured to the interior of a door panel.

Referring now to the drawings, there is illustrated in FIG. 1 a door handle chassis 10, preferably of molded plastic, secured to the inner surface of a door panel 12 at the location of a well or depression 14 where a door handle 16 and cap 18 are located on the outer surface of the panel 12.

Figure 2:
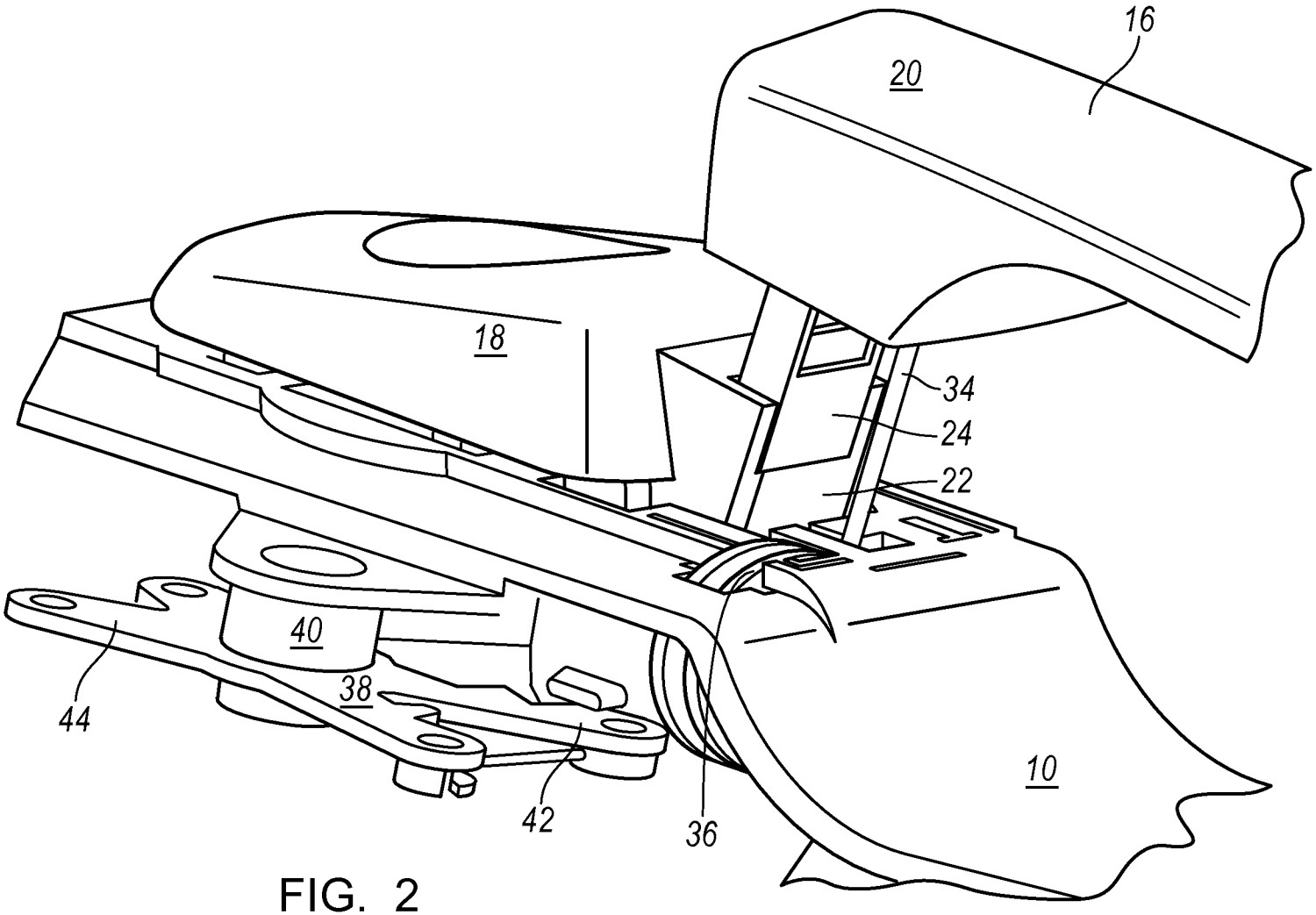
FIG. 2 is perspective view showing the door handle, cap and bellcrank mounted on the handle chassis, with the door panel removed for clarity.
Figure 3:
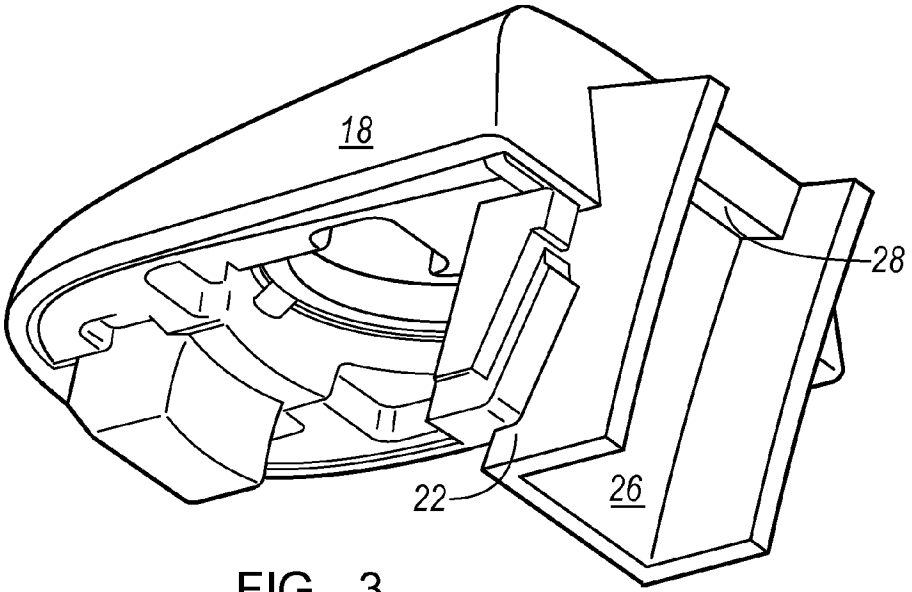
FIG. 3 is a perspective view of the cap and stop member shown in FIG. 2.

FIGS. 2 and 3 show that the handle 16 is a lever that pivots at one end 19 and is restrained by a handle stop at an opposite end 20 to limit pivoting of the handle 16. The cap 18 extends through the door panel 12, is secured to the chassis 10, and carries a handle lever stop member 22. An arm 24, extending inboard from the end 20 of handle 16, travels in a channel 26 on the stop member 22 and contacts a stop surface 28 to limit the range in which the handle 16 can pivot.

Figure 4:
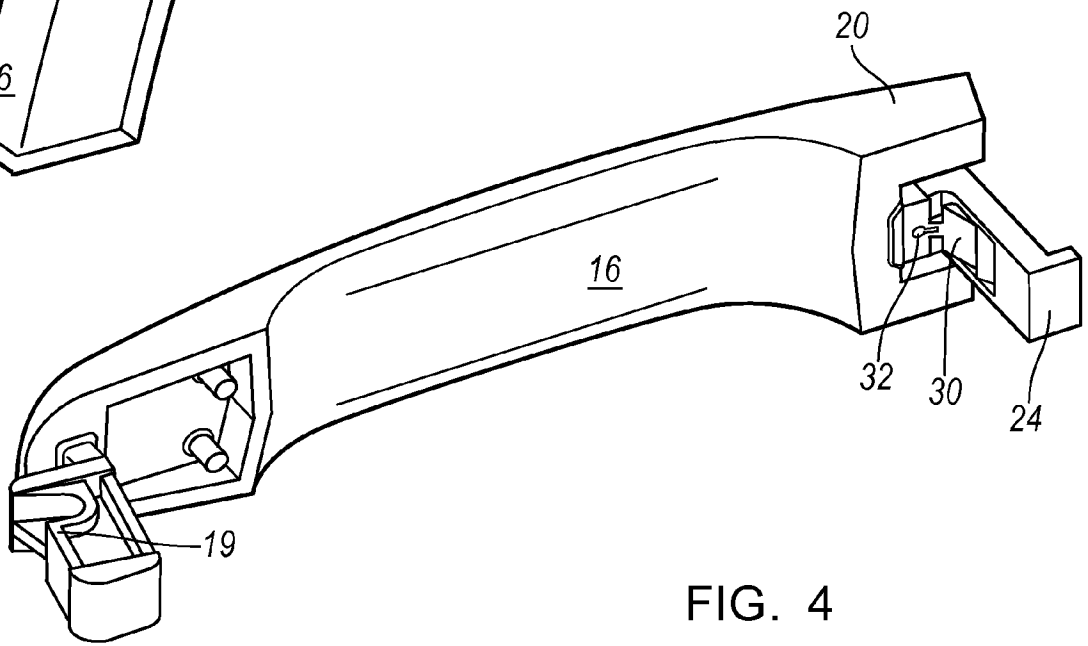
FIG. 4 is a perspective view showing the inboard surface of the door handle.

FIG. 4 shows a cable retainer 30 secured to the door handle 16 near the arm 24. A cable 34 is retained to the door handle lever 16 with a snap-in retainer 30, whose functions include retaining the cable to the handle chassis 10 in a pre-assembled condition, being retained in grooves on the handle lever 16, snapping into a notch in a partially assembled position in the handle lever 16, and snapping into a final position in the handle lever 16. The cable retainer 30 is formed with a hole 32 through which a cable enters and is secured to the retainer 30 and the end 20 of the door handle 16.

Figure 5:
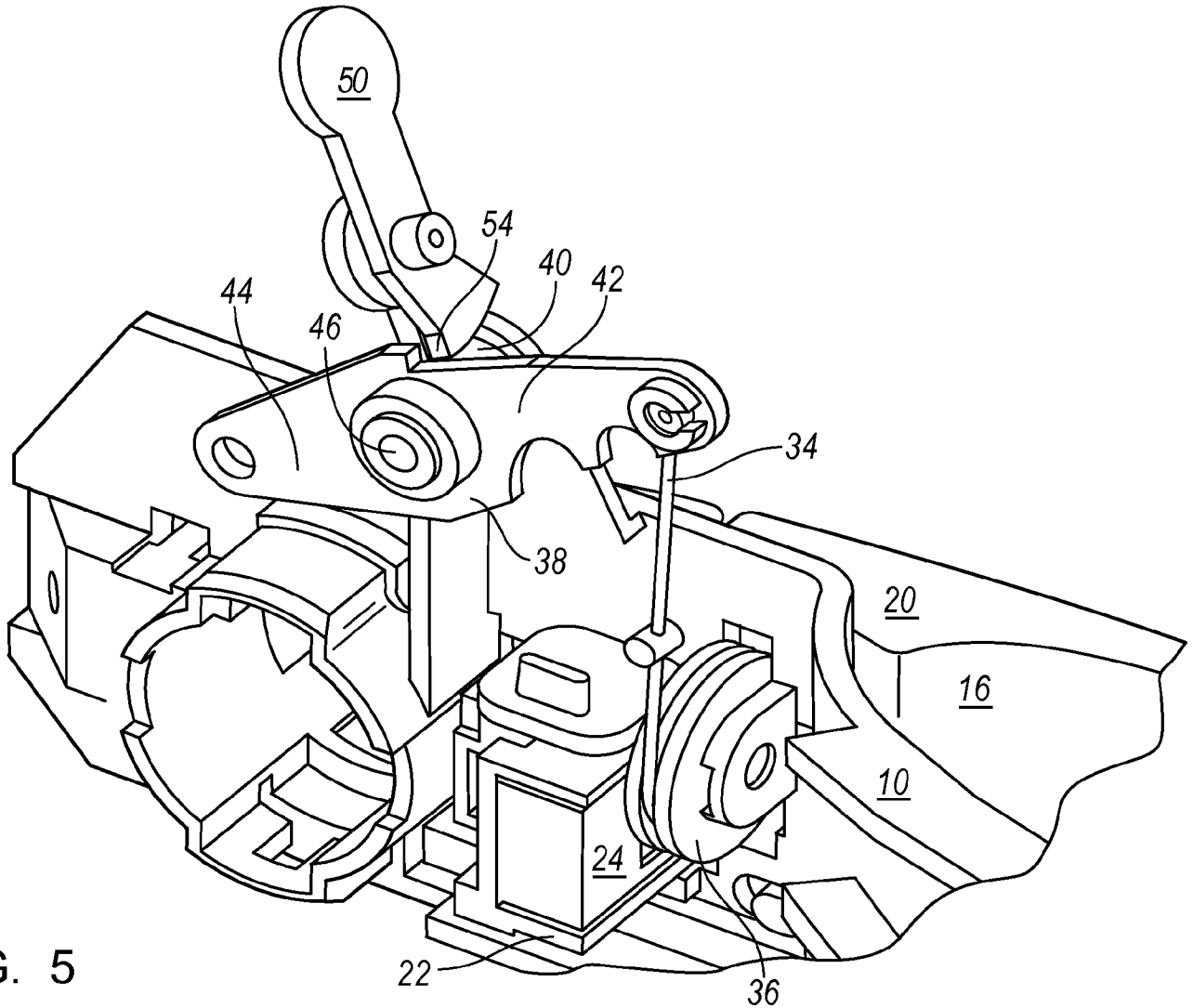
FIG. 5 is a perspective side view of the door mechanism.

FIGS. 2 and 5 show the cable 34 extending inboard from retainer 30, engaging a pulley 36 mounted on the handle chassis 10 and connected to a bellcrank 38, which is supported to pivot on an boss 40 formed on the inner surface of the chassis 10. The bellcrank 38 has a first arm 42, to which the cable 34 is connected, and a second arm 44 at the opposite side of the bellcrank pivot from arm 42, for actuating a door latch. Preferably a torsion spring 46 engages boss 40 and bellcrank 38 and applies a moment to bellcrank 38 tending to pivot handle 16 inboard, arm 42 upward, and arm 44 downward.

When the handle 16 is pulled outboard, arm 42 pivots downward and arm 44 pivots upward. A torsion spring 46 engages boss 40 and bellcrank 38 and applies a moment to the bellcrank tending to pivot handle 16 inboard, arm 42 upward, and arm 44 downward. When the handle 16 is released, arm 42 pivots upward and arm 44 pivots downward in the direction of the moment produced by spring 46. Both the upward and downward positions of arms 42, 44 are illustrated in FIG. 2.

FIG. 5 shows the positional state of the bellcrank 38 when handle 16 is released. An inertial lock lever pivots laterally on the handle chassis 10 toward and away from engagement with bellcrank 38. When lever 50 is subjected to a high lateral acceleration directed outboard, the weighted end 52 of lever 50 pivots outboard and causes a latch 54 on the lower end of the lever to pivot inboard into engagement with bellcrank 38, preventing bellcrank 38 from pivoting and retaining its arm 44 engaged with a door latch 62.

Figure 6:
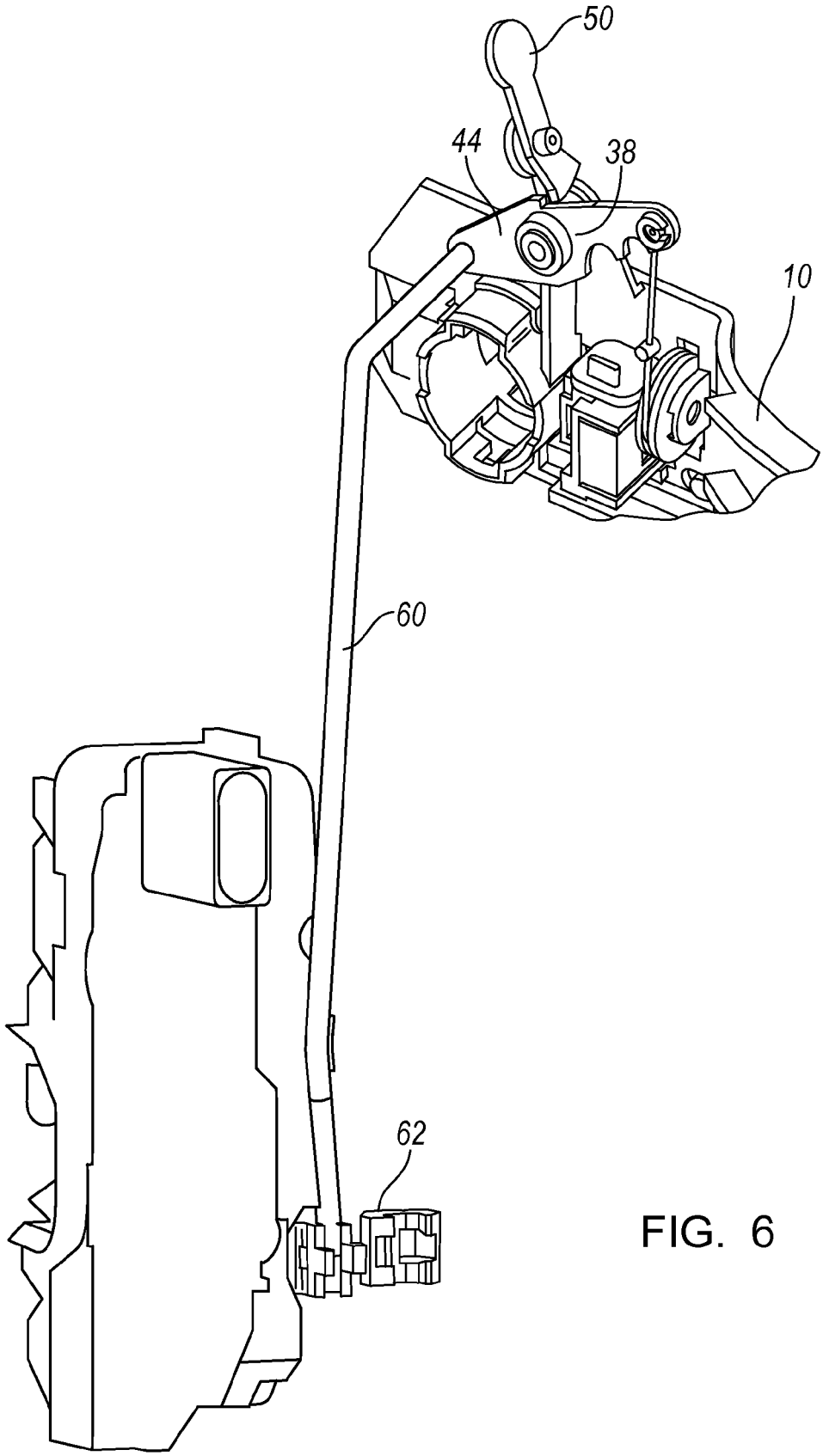
FIG. 6 is a perspective view of the door mechanism of FIG. 1 showing the bellcrank connected to a door latch.

FIG. 6 shows a rod 60 connected to arm 44 of bellcrank 38 and connected at its opposite end to a door latch 62, which alternately engages and disengages a striker. When arm 44 pivots upward, rod 60 moves latch 62 upward to disengage the striker and allow the door 12 to open as handle 16 is pulled outward. When arm 44 pivots downward, rod 60 moves latch 62 downward to engage the striker, preventing the door 12 from opening.

Figure 7:
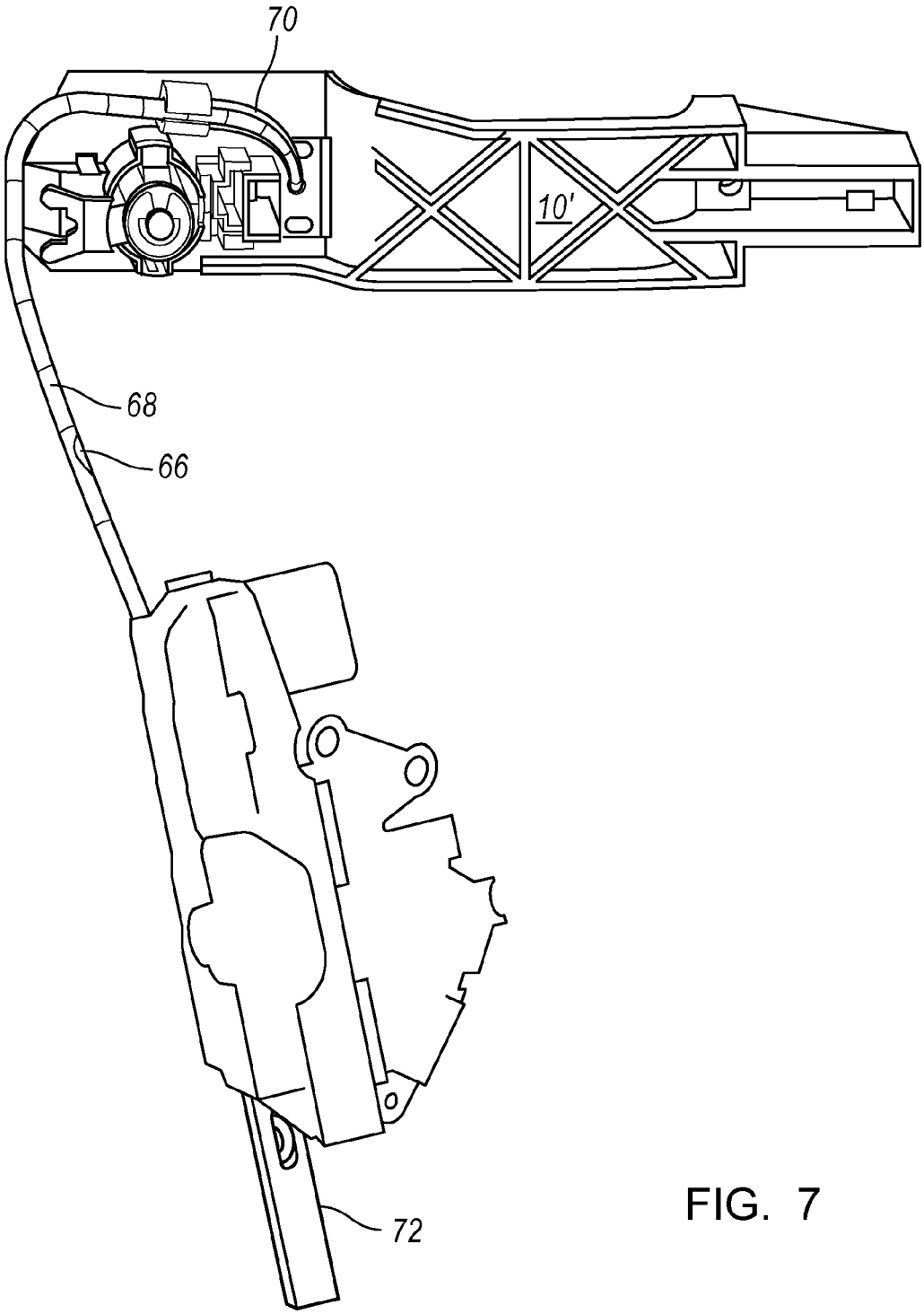
FIG. 7 is a perspective view of an alternate actuating mechanism.

Bellcrank 38 and pulley 36 may be replaced by a cable 66 and latch 72, as shown in FIG. 7. The cable 66 is attached to the door handle 16, moves in a conduit 68 along a cable track 70 formed in a handle chassis 10' leading to the handle 16, and is attached to the door latch 72. The conduit encloses the cable along its length between the latch 72 and door handle 16.

When the door handle 16 is pulled outward, cable 66 moves latch 72 upward to disengage the striker and allow the door 12 to open. When the door handle 16 is released, latch 72 is forced downward by the cable 66 and handle 16, causing the latch 72 to engage the striker and preventing the door 12 from opening.

By moving the handle lever stop 28 from a conventional position on the handle chassis 10 to the handle cap 18, the stop can be moved outboard, thereby considerably reducing the depth of the handle packaging envelope.

While certain embodiments of the present invention have been described in detail, those familiar with the art to which this invention relates will recognize various alternative designs and embodiments for practicing the invention as defined by the following claims.

What is claimed is:

1. An apparatus for operating an automotive vehicle door, comprising:

a movable door latch having an open state for unlatching the door and a closed state for latching the vehicle door;

a pivoting door handle having a portion located outboard of a door panel of the vehicle door having a pivot end pivotally secured relative to the door panel for pivoting about the pivot end, and an opposed sliding end configured for sliding in an outboard direction relative to the door panel for unlatching and opening the vehicle door and movable in an opposed inboard direction for latching the vehicle door, the pivoting door handle having an arm extending inboard of the door panel from the sliding end;

a cap fixed to the door panel, having a portion located outboard of the door panel, the cap adjacent to the sliding end, the cap including an inboard extending channel within which the arm is slidably engaged, the channel including a stop, the stop being located outboard of the door panel and configured to directly contact the arm to limit the maximum movement of the sliding end in the outboard direction; and a cable secured to the sliding end of the handle, outboard of the door panel for all positions of the pivoting door handle, for transmitting movement of the sliding end of the handle to the latch.

2. The apparatus of claim 1 further comprising:

a pivoting bellcrank including a first arm secured to the cable and a second arm connected to the latch, the bellcrank oriented for pivoting opposed ends of the first and second arms in a vertical direction; and a pulley engaged with the cable for transmitting movement of the handle to the first arm.

3. The apparatus of claim 1 wherein the door handle is located on an external surface of the door panel.

4. The apparatus of claim 1 further comprising:

a pivoting bellcrank including a first arm secured to the cable and a second arm connected to the latch, the bellcrank oriented for pivoting opposed ends of the first and second arms in a vertical direction; and a locking lever directly engageable with the bellcrank in response to acceleration of the vehicle door directed outboard relative to the door panel to prevent pivoting of the bellcrank.

5. The apparatus of claim 1 wherein the cable is secured directly to the sliding end of the handle by a cable retainer.

6. An apparatus for operating an automotive vehicle door, comprising:

a moveable door latch having an unlatched state and a latched state that changes in response to movement of a pivotable door handle;

a handle chassis located interior to a door panel of the vehicle door and supporting a pivotable bellcrank, the movable door latch operatively connected to the bellcrank;

the pivotable door handle having a pivot end pivotally engaging the handle chassis for pivoting about the pivot end, and an opposed sliding end configured for sliding in an outboard direction relative to the door panel for unlatching and opening the vehicle door and movable in an opposed inboard direction for latching the vehicle door, the door handle having an arm extending inboard from the sliding end;

a cap fixed to the handle chassis adjacent to the sliding end, the cap having a portion being located outboard of the door panel and including an inboard extending channel within which the arm is slidably engaged, the channel including a stop, the stop being located outboard of the door panel and configured to directly contact the arm to limit the maximum movement of the sliding end in the outboard direction; and a cable extending through the handle chassis and secured to the sliding end of the handle for transmitting movement of the sliding end of the handle to the bellcrank.

7. The apparatus of claim 6 further comprising a pulley supported on the handle chassis and engaged with the cable.

8. The apparatus of claim 6 further comprising a cable retainer secured to the door handle and movable in response to pivoting of the handle.

9. The apparatus of claim 6 wherein the door handle is located on an external surface of the door panel.

10. The apparatus of claim 6 further comprising:

a locking lever engageable with the bellcrank in response to acceleration of the vehicle door directed outboard relative to the door panel to prevent pivoting of the bellcrank, the bellcrank oriented for pivoting opposed ends of the first and second arms in a vertical direction.

11. The apparatus of claim 6 wherein the inboard extending channel extends from the cap inboard through the handle chassis.

* * * * *